US010018195B1

(12) United States Patent
McLoughlin

(10) Patent No.: US 10,018,195 B1
(45) Date of Patent: Jul. 10, 2018

(54) INTAKE PRESSURE CONTROL SYSTEM

(71) Applicant: John E. McLoughlin, Hauppage, NY (US)

(72) Inventor: John E. McLoughlin, Hauppage, NY (US)

( * ) Notice: Subject to any disclaimer, the term of this patent is extended or adjusted under 35 U.S.C. 154(b) by 0 days.

(21) Appl. No.: 15/433,734

(22) Filed: Feb. 15, 2017

(51) Int. Cl.

| | |
|---|---|
| ***F04B 49/08*** | (2006.01) |
| ***F04B 17/05*** | (2006.01) |
| ***F04B 49/06*** | (2006.01) |
| ***F04B 49/20*** | (2006.01) |
| ***F04B 49/24*** | (2006.01) |
| ***A62C 31/00*** | (2006.01) |

(52) U.S. Cl.
CPC ..... *F04B 49/06* (2013.01); *A62C 31/00* (2013.01); *F04B 17/05* (2013.01); *F04B 49/08* (2013.01); *F04B 49/20* (2013.01); *F04B 49/24* (2013.01); *F04B 2203/0605* (2013.01); *F04B 2205/02* (2013.01); *F04B 2205/04* (2013.01); *F04B 2205/151* (2013.01)

(58) Field of Classification Search
CPC ..... Y10T 137/776; Y10T 137/7761; Y10T 137/87265; Y10T 137/8733; Y10T 137/8741; Y10T 137/87507; Y10T 137/87306; Y10T 137/8731; A62C 27/00; A62C 5/002; A62C 99/009; A62C 31/00; F04B 17/05; F04B 17/06; F04B 2205/01; F04B 2205/05; F04B 49/06; F04B 49/08; F04B 49/20; F04B 49/24; F04B 2203/0605; F04B 2205/02; F04B 2205/04; F04B 2205/151
USPC .... 137/599.01, 599.09, 601.01, 601.14, 487, 137/487.5, 599.06, 599.07; 417/44.3; 169/43, 46
See application file for complete search history.

(56) References Cited

U.S. PATENT DOCUMENTS

| | | | | | |
|---|---|---|---|---|---|
| 1,591,401 | A * | 7/1926 | Palmer | A62C 5/002 | 169/15 |
| 5,172,717 | A * | 12/1992 | Boyle | E21B 34/06 | 137/155 |
| 6,138,767 | A * | 10/2000 | La Vergne | A62C 5/02 | 169/15 |
| 7,909,112 | B2 * | 3/2011 | Decker | A62C 27/00 | 169/24 |
| 8,307,907 | B2 * | 11/2012 | Laskaris | A62C 5/02 | 169/13 |
| 8,418,773 | B2 * | 4/2013 | Cerrano | A62C 37/00 | 169/46 |

(Continued)

FOREIGN PATENT DOCUMENTS

CN 201765499 U * 3/2011

OTHER PUBLICATIONS

English Abstract of CN 201765499U dated Mar. 16, 2011.*

*Primary Examiner* — Nathan Zollinger
(74) *Attorney, Agent, or Firm* — Louise S. Heim

(57) ABSTRACT

A pump intake pressure control apparatus includes a conduit joining a pump to a liquid source, a flow controller configured to control the flow of liquid through the conduit, pressure sensors for detecting the pressure of the liquid in the conduit upstream and downstream of the flow controller, and an electronic master controller programmed to receive input from the pressure sensors and to actuate the flow controller to reduce the pressure downstream of the flow controller to a predetermined approximate value.

20 Claims, 1 Drawing Sheet

(56) References Cited

U.S. PATENT DOCUMENTS

| | | | | |
|---|---|---|---|---|
| 8,517,696 | B2 * | 8/2013 | McLoughlin | F04B 17/06<br>417/282 |
| 2013/0105182 | A1 * | 5/2013 | McLoughlin | G05D 9/12<br>169/46 |

* cited by examiner

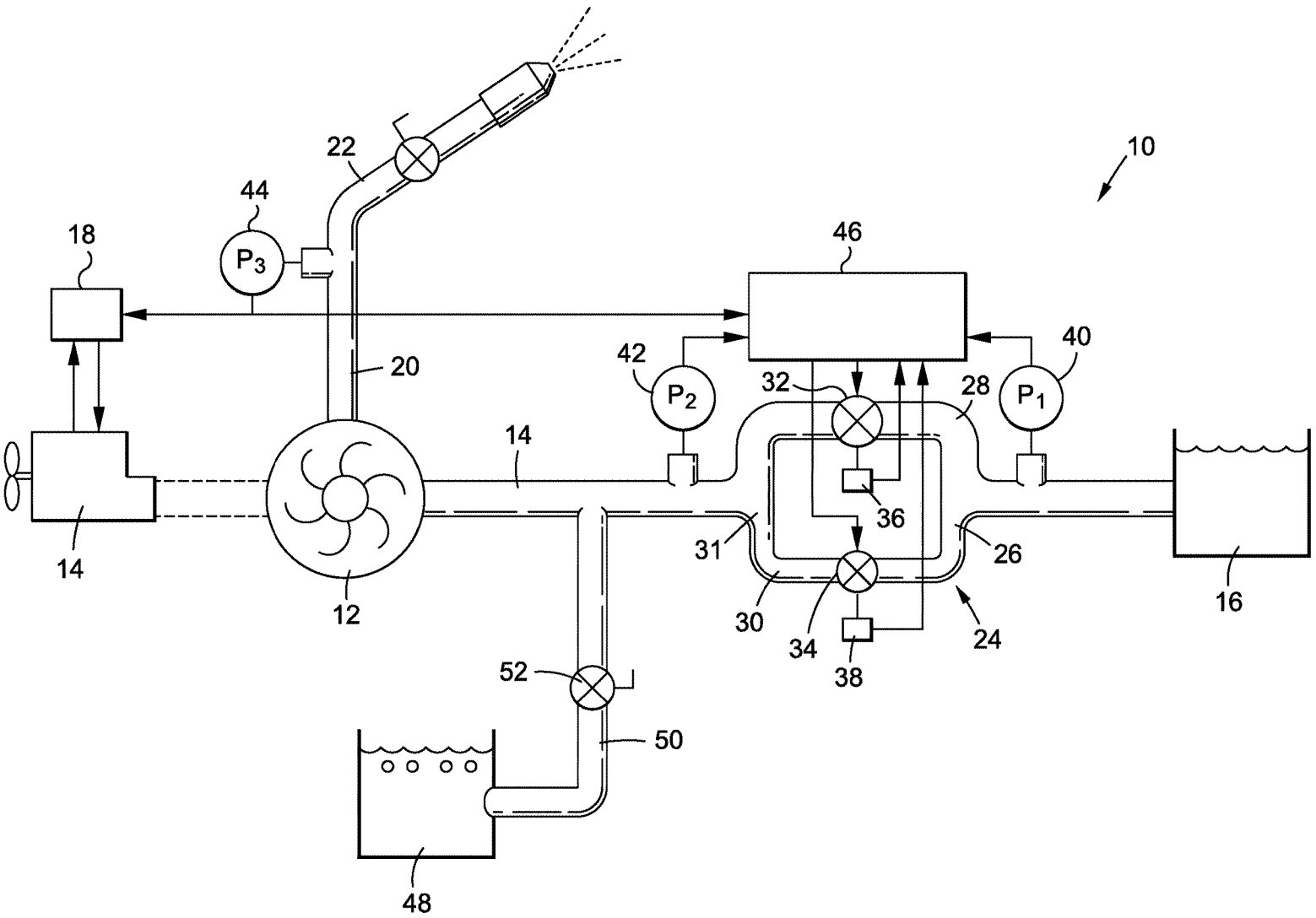
10
16
40
P1
28
26
24
46
36
38
32
34
30
31
P2
42
50
52
14
48
20
22
12
44
P3
18
14

INTAKE PRESSURE CONTROL SYSTEM

TECHNICAL FIELD

This disclosure relates to pressure control systems, and more particularly, to an intake pressure control system for a mobile pumping apparatus such as a fire truck.

BACKGROUND

Over the years, various systems have been devised for controlling engine-driven fire pumps. For instance, U.S. Pat. Nos. 3,786,689 A and 4,189,005 A to McLoughlin, as well as U.S. Pat. No. 5,888,051 A to McLoughlin et al., disclose apparatus and methods for controlling the pressure output from engine-driven centrifugal fire pumps. U.S. Pat. No. 7,040,868 B2 to McLoughlin et al. discloses systems for controlling pumping speed during discharge pressure fluctuations. U.S. Pat. No. 8,517,696 B2 to Mcloughlin et al. discloses a system for maintaining the fluid intake pressure of a pumping system above a preset value, while U.S. Patent Application Publication No. 2005/0061373 A1 to McLaughlin (sic) et al. discloses a system for maintaining the fluid intake pressure below a preset value.

One disadvantage of pump pressure governors that only control discharge pressure is that they are often unresponsive, or too slow to respond to, sudden pressure changes at the intake end of the system. Also, these types of governors are simply not able to reduce extremely high incoming pressure—for instance, pressure of 200 psi or higher—to a safe discharge pressure of approximately 100 psi. In addition, these type pressure control systems do not include any backup mechanisms for controlling the discharge pressure if the governor should fail.

A disadvantage of currently available systems that control intake pressure is that they are typically designed only for use with pressurized fluid sources. Such intake control systems are not useful when fire hydrants are unavailable and firefighters instead must rely on an unpressurized fluid source such as the over 500-gallon water tank which is normally carried on fire trucks, or an external source such as a lake or pond. Furthermore, such systems are not capable of siphoning foam or other additives from an auxiliary tank upstream of the pump.

The present invention addresses these problems as described below.

SUMMARY

A pump intake pressure control apparatus according to the present disclosure comprises a conduit joining a pump to a liquid source, a flow controller configured to control the flow of liquid through the conduit, pressure sensors configured to detect the pressure of the liquid in the conduit upstream and downstream of the flow controller, and an electronic master controller programmed to receive input from the pressure sensors and to actuate the flow controller to reduce the pressure downstream of the flow controller to a predetermined approximate value.

The pressure sensors may comprise a first pressure sensor upstream of the flow controller and a second pressure sensor downstream of the flow controller. The flow controller may comprise a valve located in the conduit between the first and second pressure sensors. In a preferred embodiment, the flow controller divides the flow into two branches, with a valve located in each branch. The branches, one of which may be larger in diameter than the other, diverge from one another at a bifurcated inlet end downstream of the first pressure sensor, and converge toward one another at an outlet junction upstream of the second pressure sensor. The electronic master controller is programmed to actuate the first and second valves independently of one another.

The flow controller may also include position indicators configured to indicate the positions of the valves, and the electronic master controller may be configured to receive input from the position indicators.

The pump intake pressure control apparatus may be part of a system including a liquid source, wherein the liquid source is a pressurized source such as a fire hydrant. Alternatively, the liquid source may be a non-pressurized source such as a pond. In the case of a non-pressurized source, the pressures upstream and downstream of the flow controller are negative. The system may also include an additive tank containing an additive such as firefighting foam. The additive tank is coupled to the conduit at a location between the second pressure sensor and the pump, and a negative pressure at this location causes additive to be siphoned through the additive line into the conduit, where it mixes with the liquid.

BRIEF DESCRIPTION OF THE DRAWINGS

FIG. 1 is a schematic diagram of a pressure control system according to the present disclosure.

DETAILED DESCRIPTION

Turning now to the drawings, which are not necessarily to scale, and wherein some features may be exaggerated or minimized to show details of particular components, FIG. 1 shows a pressure control system according to the present disclosure, indicated in its entirety by the numeral 10. The system 10 includes a pump 12, for instance a centrifugal pump, connected by an intake conduit 14 to an inlet source 16 containing a liquid such as water. The inlet source 16 may be either a pressurized source such as a fire hydrant, or a non-pressurized source such as a pond, lake, or onboard tank.

The pump 12 is driven by an engine 14, the speed and other characteristics of which are controlled by a governor 18. The entire system 10, or parts of it, may be incorporated into a vehicle such as a fire truck. A discharge conduit 20 leading from the pump 12 is connected to at least one valved hose 22 or similar discharge line.

A flow controller 24 is provided in the intake conduit 14 between the inlet source 16 and the pump 12. The flow controller 24 includes a bifurcated inlet end 26 that divides the intake conduit 14 into a first branch 28 and a second branch 30. The second branch 30 preferably has a larger cross-sectional area than the first branch 28. The two branches 28, 30 converge at an outlet junction 31.

A first valve 32 in the first branch 28 controls the flow of liquid through the first branch 28, and a second valve 34 in the second branch 30 controls the flow of liquid through the second branch 30. The first valve 32 is coupled to a first position indicator 36, and the second valve is coupled to a second position indicator 38. The valves 32, 34 may be servo driven or, alternatively, could be driven hydraulically, pneumatically, or by water pressure from the pump.

A first pressure sensor 40 is provided in or on an upstream section of the intake conduit 14 between the inlet source 15 and the flow controller 24, and a second pressure sensor 42 is provided in or on a downstream section of the intake conduit 14 between the flow controller 24 and the pump 12.

A third pressure sensor 44 is provided in or on the discharge conduit 20. The pressure sensors 40, 42, 44, valves 32, 34, and position indicators 36, 38 are electronically coupled to an electronic master controller 46 such as a computer.

The flow controller 24 is programmed to operate when the third pressure sensor 44 detects that there is discharge from the pump 12, since there is no need to regulate pressure if there is no discharge. Once discharge is detected, the first valve 32 opens, allowing liquid to flow through the first branch 28 of the intake conduit 14. The master controller 46 monitors the pressures p1, p2 at first and second pressure sensors 40, 42, respectively, and varies the position of the first valve 32 as needed to keep the pressure p2 at the second pressure sensor 42 at or below a predetermined safe value $P_{safe}$. For most applications, a pressure of approximately 50 psi is considered safe, but $P_{safe}$ may vary depending on the operating procedure of the fire department or the requirements of the pump operator.

If the pressure drop through the flow controller 24 becomes too great to be effectively regulated by the first valve 32 alone, the second valve 34 will open, and its position controlled by the master controller 46 as needed to maintain p2 at or below $P_{safe}$. At the same time, the governor 18 may regulate the speed of the engine 14 to control the discharge pressure p3 as measured by the third pressure sensor 44.

In one firefighting scenario, for instance when using a fire hydrant at the bottom of a hill in a hilly area, the incoming pressure p1 may be 200 psi high or higher. In such a scenario, the master controller 46 would open and close first and second valves 32, 34 as needed to maintain p2 at approximately 50 psi or less. The governor 18 would then increase the engine rpm as needed to raise p3 back to a pressure high enough to effectively extinguish the fire, but low enough to remain safe for the firefighters (typically about 100 psi). On the other hand, if the governor 18 were to fail, resulting in too high a discharge pressure p3, the master controller 46 could manipulate the first and second valves 32, 33 to provide some regulation of p3.

In another scenario, when drawing water from an unpressurized source such as a pond, lake, or onboard water tank, the pressure p1 at the first pressure sensor 40 and the pressure p2 at the second pressure sensor 42 would both need to be negative, in order to create suction for drawing the water from the source. The master controller 46 and governor 18 would operate in the same manner as in the previous scenario, except that $P_{safe}$ would be set to a negative value.

In either of the two above scenarios, it may desirable to mix an additive such as a firefighting foam into the liquid in the intake conduit 14. In such a case, the additive could be stored in an additive tank 48 coupled to the intake conduit 14 by an additive conduit 50 that enters the system between the flow controller 24 and the pump 12. As in the second scenario, $P_{safe}$ would be set to a negative value. This would create suction at second pressure sensor 42, causing the additive in the additive tank 48 to be siphoned into the intake conduit 14, where it mixes with the liquid. A calibrated valve 52 in the additive line 50 would allow an operator to control the amount of additive entering in proportion to the liquid. For instance, an amount of foam equal to about 3 to 6% of the total mixture could be added. The calibrated valve 52 could be operated either manually or electronically.

While the principles of the invention have now been made clear in the illustrated embodiment, there may be immediately obvious to those skilled in the art many modifications of structure, arrangements, proportions, elements, materials and components used in the practice of the invention and otherwise, which are particularly adapted for specific environments and operation requirements without departing from those principles. For instance, in some systems where very large variations in intake pressure and flow are not expected, the flow controller 24 may comprise a single valve rather than the two valves shown in the illustrated example. The appended claims are therefore intended to cover and embrace any such modifications within the limits only of the true spirit and scope of the invention.

What is claimed is:

1. An apparatus for controlling the pressure of liquid entering a pump coupled to a liquid source, comprising:
- a conduit conducting liquid from the liquid source to the pump, the conduit including a bifurcated section having
  - a first branch conducting liquid towards the pump,
  - a second branch conducting liquid towards the pump,
  - an inlet end wherein the conduit splits to form the first and second branches, and
  - an outlet end wherein the first and second branches converge;
- a valve configured to control the flow of liquid through the first branch;
- pressure sensors for detecting the pressure of liquid in the conduit upstream and downstream of the bifurcated section; and
- an electronic master controller programmed to receive input from the pressure sensors and to actuate the valve to reduce the pressure downstream of the bifurcated section to a predetermined approximate value.

2. The apparatus according to claim 1, further comprising a second valve configured to control the flow of liquid in the second branch.

3. The apparatus according to claim 2, wherein the first valve is located in the first branch and the second valve is located in the second branch.

4. The apparatus according to claim 2, wherein the electronic master controller is programmed to actuate the first and second valves independently of one another.

5. The apparatus according to claim 1, further comprising:
- a position indicator configured to detect the position of the valve;
- wherein the electronic master controller is configured to receive input from the position indicator.

6. The apparatus according to claim 2, further comprising:
- a first position indicator configured to detect the position of the first valve; and
- a second position indicator configured to detect the position of the second valve;
- wherein the electronic master controller is configured to receive input from the first and second position indicators.

7. The apparatus according to claim 1, wherein one of the branches of the conduit has a larger cross-sectional area than the other branch of the conduit.

8. An intake pressure control system for controlling the flow of liquid into a pump, comprising:
- a pressurized liquid source;
- a conduit conducting liquid from the pressurized liquid source to the pump, the conduit including a bifurcated section having;
  - a first branch conducting liquid towards the pump,
  - a second branch conducting liquid towards the pump,
  - an inlet end wherein the conduit splits to form the first and second branches, and
  - an outlet end wherein the first and second branches converge;

a valve located in the first branch of the conduit and configured to control the flow of liquid through the conduit;

a first pressure sensor located between the pressurized liquid source and the valve, and configured to detect a pressure p1 of liquid in the conduit upstream of the valve;

a second pressure sensor located between the valve and the pump and configured to detect a pressure p2 of the liquid in the conduit at a position between the valve and the pump; and an electronic master controller programmed to receive input from the pressure sensors and to actuate the valve to reduce the pressure p2 to a predetermined approximate value.

9. The intake pressure control system according to claim 8, wherein the valve is a first valve, and further comprising a second valve located in the second branch.

10. The intake pressure control system according to claim 8, further comprising:

a discharge conduit configured to discharge liquid from the pump; and a third pressure sensor adapted to detect a pressure p3 of liquid in the discharge conduit;

wherein the electronic master controller is programmed to receive input from the first, second, and third pressure sensors and to control p2 and p3 accordingly.

11. The intake pressure control system according to claim 9, wherein the master controller is programmed to operate the second valve independently of the first valve.

12. The intake pressure control system according to claim 9, further comprising:

a first position indicator configured to detect the position of the first valve; and a second position indicator configured to detect the position of the second valve;

wherein the electronic master controller is configured to receive input from the first and second position indicators.

13. The intake pressure control system according to claim 8, wherein one of the branches of the conduit has a larger cross-sectional area than the other branch of the conduit.

14. The intake pressure control system according to claim 10, further comprising:

an engine having a variable engine speed and configured to drive the pump; and a governor coupled to the engine and the master controller, and configured to adjust the speed of the engine to control p3.

15. An intake pressure control system for controlling the flow of fluids into a pump, comprising:

an unpressurized liquid source;

a conduit conducting liquid from the unpressurized liquid source to the pump, the conduit including a bifurcated section having;

a first branch conducting liquid towards the pump, a second branch conducting liquid towards the pump, an inlet end wherein the conduit splits to form the first and second branches, and an outlet end wherein the first and second branches converge;

a valve located in the first branch of the conduit and configured to control the flow of liquid through the conduit;

a first pressure sensor located between the pressurized liquid source and the valve, and configured to detect the pressure of liquid in the conduit upstream of the valve;

a second pressure sensor located between the valve and the pump; and an electronic master controller programmed to receive input from the pressure sensors and to actuate the valve to reduce the pressure downstream of the valve to a predetermined negative value.

16. The intake pressure control system according to claim 15, wherein the valve is a first valve, and further comprising a second valve located in the second branch.

17. The intake pressure control system according to claim 15, further comprising:

a discharge conduit configured to discharge liquid from the pump; and a third pressure sensor adapted to detect a pressure p3 of liquid in the discharge conduit;

wherein the electronic master controller is programmed to receive input from the first, second, and third pressure sensors and to control p2 and p3 accordingly.

18. The intake pressure control system according to claim 16, wherein the master controller is programmed to operate the second valve independently of the first valve.

19. The intake pressure control system according to claim 15, further comprising:

an additive tank containing an additive;

an additive line coupling the additive tank to the conduit at a location between the valve and the pump;

wherein the negative pressure downstream of the valve causes the additive to be siphoned through the additive line into the conduit, where it mixes with liquid.

20. The intake pressure control system according to claim 19, further comprising a calibrated valve in the additive line configured to control an amount of additive entering in proportion to liquid.

* * * * *